US010755845B2

(12) United States Patent
Smith et al.

(10) Patent No.: US 10,755,845 B2
(45) Date of Patent: Aug. 25, 2020

(54) TOP HEAD HOUSING

(71) Applicant: General Electric Technology GmbH, Baden (CH)

(72) Inventors: Matthew Smith, Hephzibah, GA (US); Zoltan Roman, Grovetown, GA (US)

(73) Assignee: GENERAL ELECTRIC TECHNOLOGY GmbH, Baden (CH)

( * ) Notice: Subject to any disclaimer, the term of this patent is extended or adjusted under 35 U.S.C. 154(b) by 0 days.

(21) Appl. No.: 15/563,291

(22) PCT Filed: Mar. 31, 2015

(86) PCT No.: PCT/US2015/023460
§ 371 (c)(1),
(2) Date: Sep. 29, 2017

(87) PCT Pub. No.: WO2016/159963
PCT Pub. Date: Oct. 6, 2016

(65) Prior Publication Data
US 2018/0075962 A1 Mar. 15, 2018

(51) Int. Cl.
*H01F 27/04* (2006.01)
*B65D 6/24* (2006.01)
*H01F 38/30* (2006.01)

(52) U.S. Cl.
CPC ..... *H01F 27/04* (2013.01); *B65D 11/188* (2013.01); *H01F 38/30* (2013.01)

(58) Field of Classification Search
CPC ..... B65D 11/10; B65D 11/105; B65D 11/188; B65D 11/1886; H01F 38/30; H01F 27/04; H01H 17/26
See application file for complete search history.

(56) References Cited

U.S. PATENT DOCUMENTS 3,380,009 A * 4/1968 Miller ..... H01F 38/30 336/92
3,525,908 A * 8/1970 Allmendinger ..... H01F 38/30 336/174

(Continued)

FOREIGN PATENT DOCUMENTS

AT 274132 B * 9/1969 ..... H01F 38/30
CN 201282024 Y 7/2009

(Continued)

OTHER PUBLICATIONS

English translation of Schieman (DE 1563434 A1), dated Oct. 30, 1969, translated in May 2019 (Year: 2019).*

(Continued)

*Primary Examiner* — Robert J Hoffberg
(74) *Attorney, Agent, or Firm* — Eversheds Sutherland (US) LLP

(57) ABSTRACT

A top head housing for a current transformer, mounted on top of an insulating column of the current transformer, and forming a chamber for windings of the current transformer, the top head housing being made of two parts fixed one to the other, and including two openings through each of which a conductor penetrates the chamber, the openings being symmetrically opposed with reference to a main vertical axis of the top head housing, wherein the two parts of the top head housing consist of two half shells including identical bodies.

10 Claims, 2 Drawing Sheets

(56) References Cited

U.S. PATENT DOCUMENTS

| | | | | | |
|---|---|---|---|---|---|
| 3,772,625 | A | | 11/1973 | Raupach | |
| 3,835,429 | A | * | 9/1974 | Hermstein | H01F 38/30 336/174 |
| 3,858,752 | A | * | 1/1975 | Marvin, Jr. | B65D 11/188 220/325 |
| 3,952,903 | A | * | 4/1976 | Sanders | B65D 11/188 220/4.24 |
| 4,274,135 | A | | 6/1981 | Rosa et al. | |
| 4,449,110 | A | * | 5/1984 | Duchene | H01F 27/266 336/100 |
| D323,114 | S | * | 1/1992 | Sheehan | D9/420 |
| 5,114,578 | A | * | 5/1992 | Sundstrom | B01D 21/003 210/256 |
| 5,363,079 | A | * | 11/1994 | Zawada | B29C 65/58 336/175 |
| 5,391,835 | A | * | 2/1995 | Yao | H01F 27/02 174/17 LF |
| 5,548,081 | A | * | 8/1996 | Rost | H01B 17/28 174/138 G |
| 5,878,907 | A | * | 3/1999 | Graf | B65D 11/06 220/324 |
| 6,375,700 | B1 | * | 4/2002 | Jaroszczyk | B01D 46/10 210/493.2 |
| 6,482,247 | B2 | * | 11/2002 | Jaroszczyk | B01D 46/10 55/484 |
| 7,854,338 | B2 | * | 12/2010 | Graf | B29C 65/02 220/4.05 |
| 8,740,005 | B1 | * | 6/2014 | Holbrook | B65D 88/06 220/4.13 |
| 8,857,641 | B1 | * | 10/2014 | Moore, Jr. | B65D 88/06 220/4.12 |
| 8,859,024 | B2 | * | 10/2014 | Gass | A23G 3/563 426/104 |
| 9,260,854 | B1 | * | 2/2016 | Moore, Jr. | E03F 5/10 |
| 9,559,500 | B2 | * | 1/2017 | Carera | H02B 11/04 |
| 2012/0092115 | A1 | * | 4/2012 | Srinivasrao | H01F 38/30 336/170 |
| 2014/0306786 | A1 | * | 10/2014 | Srinivasrao | H01F 38/30 336/94 |
| 2018/0288964 | A1 | * | 10/2018 | Tamiozzo | A01K 1/0245 |
| 2019/0198241 | A1 | * | 6/2019 | Banaszczyk | H01F 27/321 |

FOREIGN PATENT DOCUMENTS

| | | | | | |
|---|---|---|---|---|---|
| DE | 1 968 209 | U | | 9/1967 | |
| DE | 1486241 | A1 | * | 5/1969 | B65D 11/188 |
| DE | 1 563 434 | A1 | | 10/1969 | |
| DE | 2 341 443 | A1 | | 3/1974 | |
| DE | 3205204 | A1 | * | 8/1983 | B65D 1/24 |
| DE | 3505938 | A1 | * | 8/1986 | B65D 11/08 |
| DE | 102009011435 | A1 | * | 8/2010 | A61L 2/26 |
| DE | 102009011528 | A1 | * | 8/2010 | A61L 2/26 |
| DE | 10 2012 202 572 | A1 | | 8/2013 | |
| FR | 2397334 | A1 | * | 2/1979 | B65D 11/188 |
| GB | 1 432 212 | A | | 4/1976 | |
| GB | 2292934 | A | * | 3/1996 | A47F 3/004 |
| WO | 98/11767 | A1 | | 3/1998 | |
| WO | 2013/124212 | A1 | | 8/2013 | |
| WO | WO-2017186324 | A1 | * | 11/2017 | H01F 27/321 |

OTHER PUBLICATIONS

International Search Report and Written Opinion issued in connection with corresponding PCT Application No. PCT/US2015/023460 dated Dec. 4, 2015.

International Preliminary Report on Patentability issued in connection with corresponding PCT Application No. PCT/US2015/023460 dated Jul. 4, 2017.

Machine Translation and First Office Action and Search issued in connection with corresponding CN Application No. 201580078677.X dated Aug. 28, 2018.

Office Action issued in Korean Application No. 10-2015-7025908, dated Mar. 19, 2020, 5 pages.

* cited by examiner

TOP HEAD HOUSING

FIELD OF THE INVENTION

Embodiments of the present invention concern a top head housing for a current transformer, which is designed to reduce the costs for its manufacturing.

Embodiments of the present invention concern more particularly a top head housing made of two parts assembled together.

BACKGROUND OF THE INVENTION

Current transformers are commonly used in metering and protective relaying in power industry where they facilitate safe measurement of large currents, often in the presence of high voltages. The rapid growth and high demand in the power generation, transmission and distribution systems impels all manufacturing utilities to design compact, optimal and cost-efficient power equipment like current transformers.

Generally, a current transformer of top core design is formed by a top head housing supported by a hollow tubular insulated column, which is, in an embodiment, fixed on a grounded base. Secondary windings are enclosed in a metallic core casing, which in turn is connected to the ground through metal tube passing centrally through the hollow insulator. Either the metallic core housing or primary conductor is insulated for the voltage class.

The top head housing generally consists of two parts fixed together, a lower part and an upper part.

Generally, the lower part is bigger and comprises most of the means for supporting the other parts of the current transformer. The upper part, of smaller size, is mostly used to hermetically close the head housing.

The two parts of the top head housing are generally made by molding. Then, the manufacturing of the top head housing needs two sets of molds.

Embodiments of the invention aim to reduce the costs and to simplify the production of the parts of a top head housing.

SUMMARY OF THE INVENTION

Embodiments of the invention concern a top head housing for a current transformer, which is to be mounted on top of an insulating column of the current transformer, and forming a chamber for windings of the current transformer, said top head housing being made of two parts fixed one to the other, and comprising two openings through each of which a conductor penetrates the chamber, said openings being symmetrically opposed with reference to a main vertical axis of the top head housing, characterized in that the two parts of the top head housing consist of two half shells comprising identical bodies.

A top head housing comprising two identical bodies of the two parts lowers the number of different parts needed for the assembly and the investment costs for manufacturing the parts.

In an embodiment, each part comprises a base and a hollow body extending vertically from the base, said body comprising an end edge which is to come in contact with the end edge of the body of the other part.

In an embodiment, said end edge is symmetrical along a horizontal axis perpendicular to said main vertical axis of the top head housing.

In an embodiment, the end edge is located in a plane tilted from the horizontal.

In an embodiment, each part comprises a flange extending radially, with respect to said main vertical axis of the top head housing, from the end edge of the body.

In an embodiment, the parts are attached to each other at their respective flanges.

In an embodiment, each flange comprises an annular groove for receiving a complementary gasket.

In an embodiment, the top head housing comprises an external connector attached to the flanges.

In an embodiment, the body comprises at least one wall in which at least part of said openings is formed.

In an embodiment, each part is formed by molding.

BRIEF DESCRIPTION OF THE DRAWINGS

Embodiments of the invention may be better understood and further advantages and uses thereof more readily apparent, when considered in view of the following detailed description of exemplary embodiments, taken with the accompanying drawings in which.

DETAILED DESCRIPTION

Figure 1:
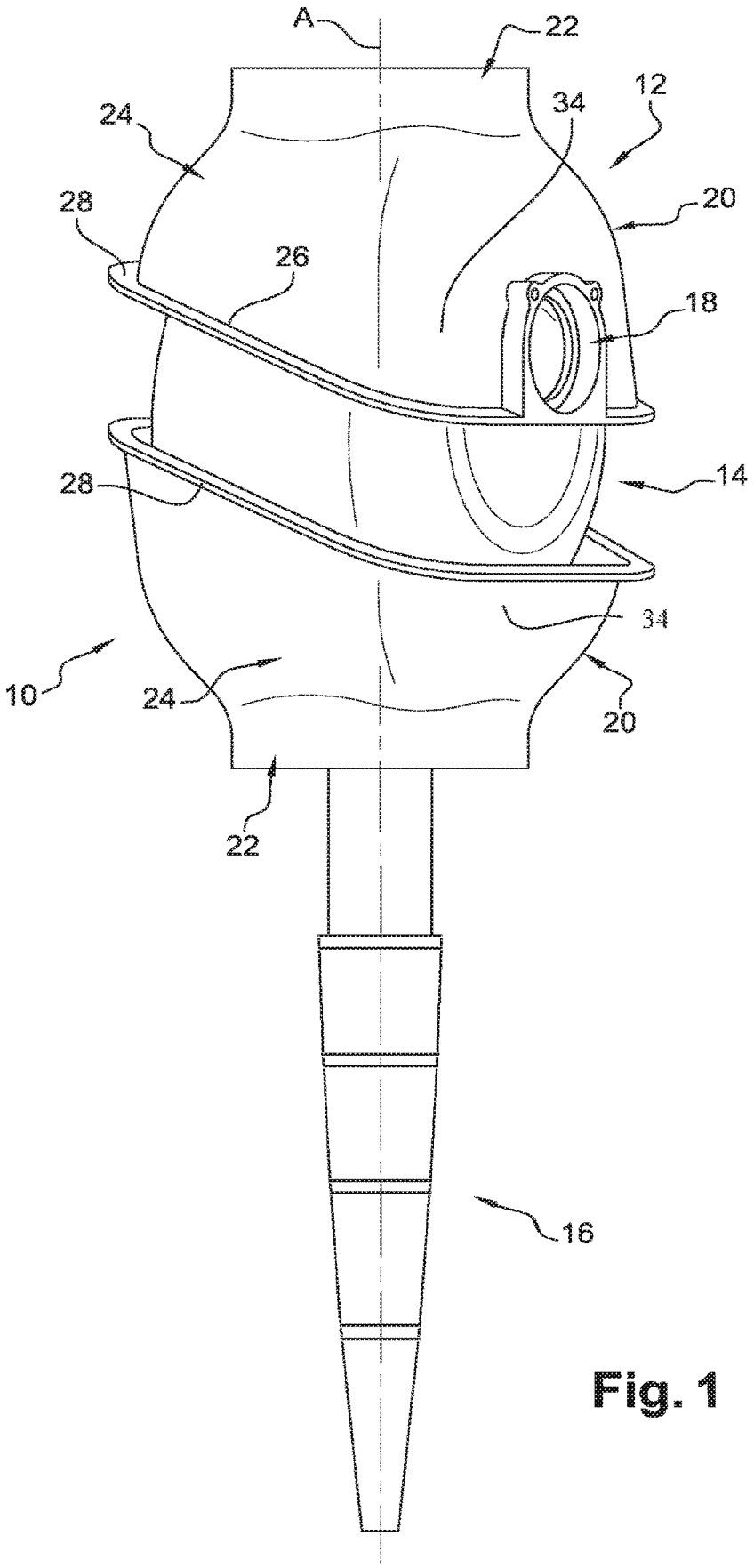
FIG. 1 represents a current transformer comprising a top head housing according to embodiments of the present invention.
Figure 2:
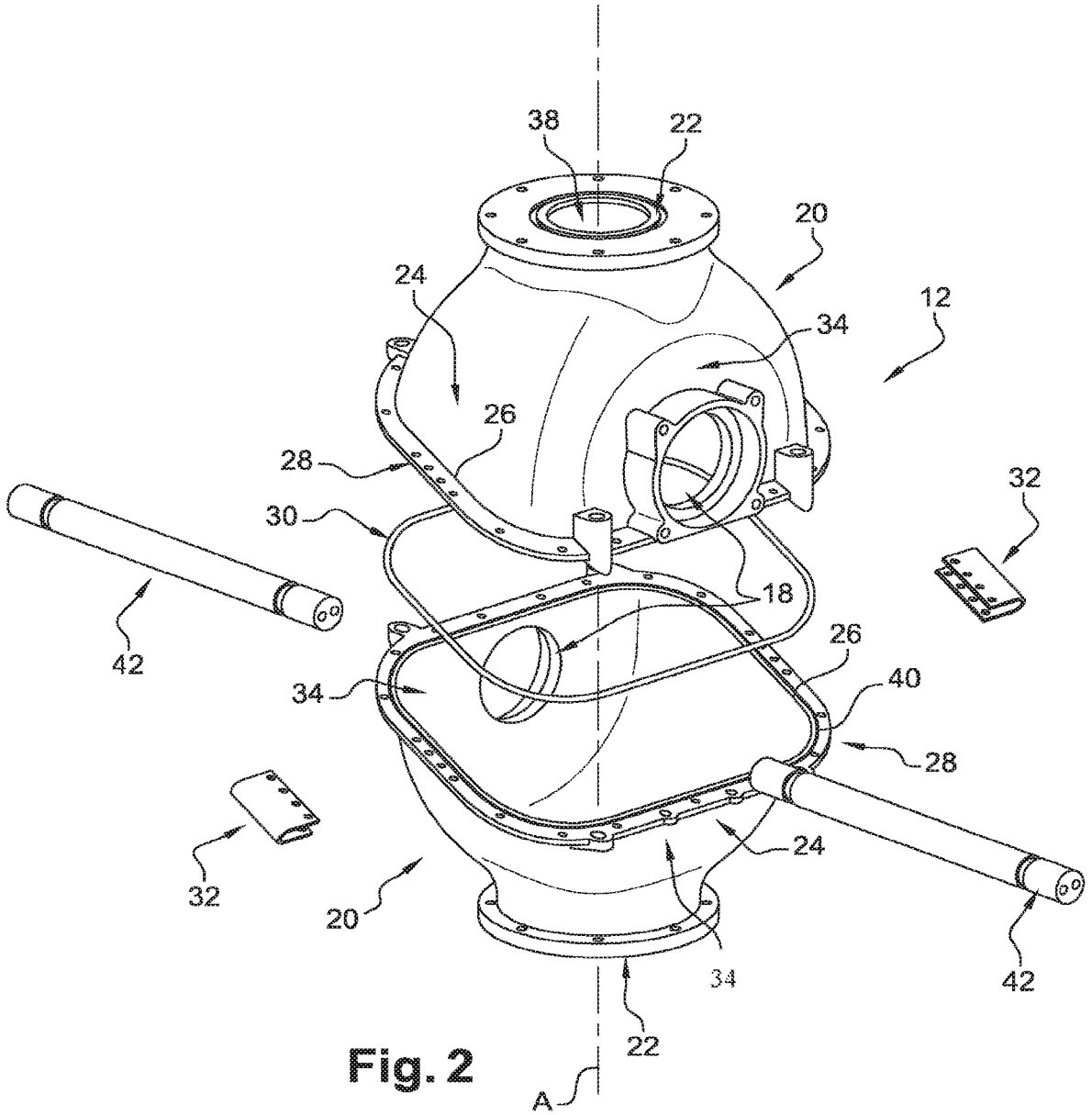
FIG. 2 is an enlarged view of the top head housing represented on FIG. 1, in an opened state.

FIG. 1 represents a current transformer 10 comprising a top head housing 12 which is a tank enclosing a plurality of primary and secondary windings 14.

The top head housing 12 is supported on top of a column 16 and comprises two openings 18 through each of which a conductor 42 penetrates inside the top head housing 12. The openings 18 are, in an embodiment, symmetrically opposed with reference to a main vertical axis A of the top head housing 12.

The top head housing 12 is made of two parts 20 fixed one to the other by conventional means, such as by bolting, which form the chamber receiving the windings 14.

Each part 20 consists of a horizontal base 22 and a hollow body 24 extending vertically from the base 22, to delimit one half of the chamber.

In an embodiment, the bodies 24 of the two parts 20 are identical and consist of two half shells. The parts 20 of the top housing 12 are disposed symmetrically around a horizontal axis and each part delimits half of the chamber receiving the windings 14.

The base 22 comprises means permitting the fixation of the associated part 20 on top of the column 16.

As the bodies 24 of the two parts 20 are identical, only the bases 22 of the parts 20 can also be identical or the can be different, depending on the component fixed thereto.

For example, here, the base 22 of the lower part 20 is fixed to the column 16, and the base 22 of the upper part 20 is connected to an expansion chamber (not shown). Then, the two bases 22 can here be different.

According to an embodiment, the base 22 comprises a hole 38 through which the column 16 passes or the internal volume of the head housing 12 is connected to the expansion chamber.

The vertical end of the body 24 forms an edge 26, which is designed to come into contact with the end edge 26 of the other part's body 24.

The edges 26 are designed in order to obtain a gastight seal when the two parts 20 are fixed one to the other. As explained before, the two parts 20 are symmetrically disposed around a horizontal axis.

Then, each edge 26 is symmetrical around the same horizontal axis, so that the two edges 26 can be matchingly superposed.

Here, each edge 26 is comprised in a plane comprising said horizontal axis, which plane is tilted from the horizontal.

It is to be understood that the top head housing is not limited to edges 26 as described above, as they can have any shape, with the condition that the shape of said edge 26 is symmetrical around a horizontal axis.

Moreover, the general plane of the edge 26 can be horizontal or tilted from the horizontal.

The two parts 20 are fixed together by means of a flange 28 on each part 20, which extends radially to the outside, with respect to a main vertical axis A of the part 20, from the edge 26 of the body.

The flanges 28 of the two parts 20 face and contact each other vertically. They are fixed together, for example by bolting. An annular gasket 30 is disposed between the two flanges to ensure a gastight closure of the chamber.

In an embodiment, each flange 28 comprises a groove 40 receiving the gasket 30.

When the two parts 20 are made of metal, as aluminium for example, they are electrically connected by an external U-shaped connectors 32 which overlap the two flanges 28.

According to the embodiment represented in the drawings, and as mentioned before, the general plane of the edge 26 is tilted from the horizontal. According to this feature, a first wall 34 of the body 24 is long enough so that an opening 18 can be arranged in that wall.

When the two parts 20 are fixed together, the first walls 34 comprising the openings 18 are opposite with respect to the vertical main axis A of the top head housing.

The top head housing 12 comprising two identical parts 20 as explained here above requires only one set of molds to produce the two parts 20.

This allows simplifying the production process by reducing the number of references and the logistics of the cast parts. This also reduces the production costs.

The assembly process is also simplified as there is no risk to invert one part 20 with the other.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A top head housing for a current transformer, which is to be mounted on top of an insulating column of the current transformer, and forming a chamber for windings of the current transformer, the top head housing comprising:

a top part and a bottom part fixed one to the other, comprising:

two openings through each of which a conductor penetrates the chamber, the two openings being symmetrically opposed with reference to a main vertical axis of the top head housing, wherein the two openings are located on opposite side portions of the top part and the bottom part, and wherein the top part and the bottom part of the top head housing consist of two half shells comprising identical hollow bodies and identical bases extruding outwards from the hollow bodies; and two holes, a first hole of the two holes located at the base of the top part and a second hole of the two holes located at the base of the bottom part.

2. The top head housing according to claim 1, wherein the top part and the bottom part each further comprise an end edge, and wherein the end edge of the top part contacts the end edge of the bottom part.

3. The top head housing according to claim 2, wherein the end edge of the top part is symmetrical to the end edge of the bottom part, and wherein the end edge of the top part and the end edge of the bottom part are adjacent to the opposite side portions of the top head housing.

4. The top head housing according to claim 2, wherein the end edge of the top part and the end edge of the bottom part are tilted.

5. The top head housing according to claim 2, wherein the top part and the bottom part each comprise a flange extending radially, with respect to the main vertical axis of the top head housing, from the end edge of the hollow body of the top part and the end edge of the hollow body of the bottom part.

6. The top head housing according to claim 5, wherein the top part and the bottom part are attached to each other at the flange of the top part and the flange of the bottom part.

7. The top head housing according to claim 5, wherein each flange comprises an annular groove for receiving a gasket between the flange of the top part and the flange of the bottom part.

8. The top head housing according to claim 5, comprising an external connector attached to the flange of the top part and the flange of the bottom part.

9. The top head housing according to claim 1, wherein the hollow body of the top part and the hollow body of the bottom part each comprise at least one wall in which at least part of the two openings is formed.

10. The top head housing according to claim 1, wherein the top part and the bottom part are each formed by molding.

* * * * *